US008220901B2

(12) United States Patent
Takeuchi et al.

(10) Patent No.: US 8,220,901 B2
(45) Date of Patent: Jul. 17, 2012

(54) LIQUID DISCHARGE HEAD AND MANUFACTURING METHOD THEREOF

(75) Inventors: Souta Takeuchi, Yokohama (JP); Yoshinori Tagawa, Yokohama (JP); Kazuhiro Asai, Kawasaki (JP); Hiroto Komiyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 310 days.

(21) Appl. No.: 12/778,829

(22) Filed: May 12, 2010

(65) Prior Publication Data

US 2010/0315467 A1 Dec. 16, 2010

(30) Foreign Application Priority Data

Jun. 16, 2009 (JP) ..... 2009-143524

(51) Int. Cl.
*B41J 2/135* (2006.01)

(52) U.S. Cl. ..... 347/45; 347/65

(58) Field of Classification Search ..... 347/40, 347/44–47, 64–67, 71
See application file for complete search history.

(56) References Cited

U.S. PATENT DOCUMENTS

| | | | | |
|---|---|---|---|---|
| 6,471,901 | B1 | 10/2002 | Kawamura | |
| 6,511,156 | B1 * | 1/2003 | Kazama et al. | 347/47 |
| 2012/0007918 | A1 * | 1/2012 | Ohtsu et al. | 347/45 |

* cited by examiner

*Primary Examiner* — Thinh Nguyen
(74) *Attorney, Agent, or Firm* — Canon USA Inc IP Division

(57) ABSTRACT

A liquid discharge head includes, a substrate, a flow path wall member provided with a wall of a liquid flow path connected to a discharge port for discharging liquid, the flow path being formed by the flow path wall member and one surface of the substrate which are in contact with each other, and a coated resin member made of a cured material of a resin composition provided to cover end surfaces of the substrate, wherein a liquid repellent member having a contact angle of the resin composition larger than that of both the flow path wall member and the one surface is provided to cover at least a part of an intersection line between an outer lateral surface of the flow path wall member and the one surface.

14 Claims, 6 Drawing Sheets

LIQUID DISCHARGE HEAD AND MANUFACTURING METHOD THEREOF

BACKGROUND OF THE INVENTION

1. Field of the Invention

The present invention relates to a manufacturing method of a liquid discharge head for discharging liquid, and specifically relates to a manufacturing method of an ink jet recording head which performs recording by discharging ink on a recording medium.

2. Description of the Related Art

As an example of use of the liquid discharge head for discharging liquid, there is an ink jet recording head applied to an ink jet recording method for performing recording by discharging ink on a recording medium.

U.S. Pat. No. 6,471,901 discusses an ink jet recording head as described below. A substrate on which energy generating elements for generating energy used to discharge liquid such as ink are provided and a discharge element substrate which is provided on the substrate and includes liquid discharge ports and a flow path wall member in which a flow path is provided. The substrate with energy generating elements and the discharge element substrate are electrically connected to a flexible wiring substrate. The side surfaces of the substrate are coated with an end surface sealing member for protecting the side surfaces from ink, dust, and the like.

However, when a difference of a linear expansion coefficient between two members is very large such as in a case of a silicon substrate and a flow path wall member made of a resin, a joint strength between the substrate and the flow path wall member may be not sufficient, and there is a risk that peeling occurs. When the peeling occurs, there may be problems as described below. For example, when providing an end surface sealing member for covering the entire side surfaces of the substrate to reliably protect side surfaces of the substrate, the sealing material may reach the top surface of the substrate depending on viscosity and fluidity of the sealing material for forming the sealing member. In this case, the sealing material may reach the side surface of the flow path wall member, and intrude into a gap between the flow path wall member and the substrate depending on the physical property of the sealing material. Due to the intrusion of the sealing material, the joint strength of the joint section between the substrate and the flow path wall member decreases, so that there is a risk of peeling. In addition, there may be a risk that liquid such as ink intrudes into the same gap. In particular, when an ink jet recording head is elongated, or the flow path wall member is thickened, the above risks increase because the stress of the flow path wall member increases.

SUMMARY OF THE INVENTION

The present invention is directed to a liquid discharge head with high reliability which prevents the sealing material from intruding into a gap between the flow path wall member and the substrate. Also, the present invention is directed to a manufacturing method for easily manufacturing such a liquid discharge head.

According to an aspect of the present invention, the liquid discharge head includes: a substrate; a flow path wall member including a wall of a liquid flow path connected to a discharge port for discharging liquid, the flow path being formed by the flow path wall member and one surface of the substrate which are in contact with each other; and a coated resin member made of a cured material of a resin composition provided to cover end surfaces of the substrate, wherein a liquid repellent member having a contact angle of the resin composition larger than that of both the flow path wall member and the one surface is provided to cover at least a part of an intersection line between an outer lateral surface of the flow path wall member and the one surface.

According to the present invention, the sealing material is prevented from intruding into a gap between the flow path wall member and the substrate, so that it is possible to provide a liquid discharge head with high reliability. Also, it is possible to easily manufacture such a liquid discharge head without placing additional burden on the manufacturing process.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinafter, exemplary embodiments of the present invention will be described with reference to the drawings.

Figure 1A:
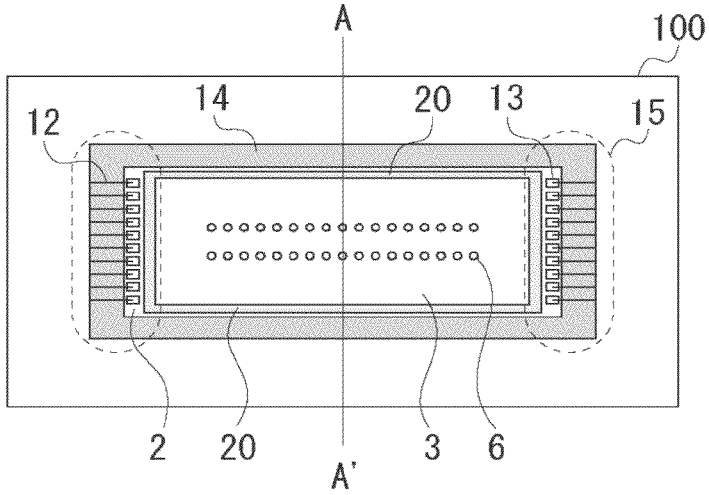
FIGS. 1A, 1B, and 1C are a schematic top view and cross-sectional views of an example of a liquid discharge head of the present invention.
Figure 1B:
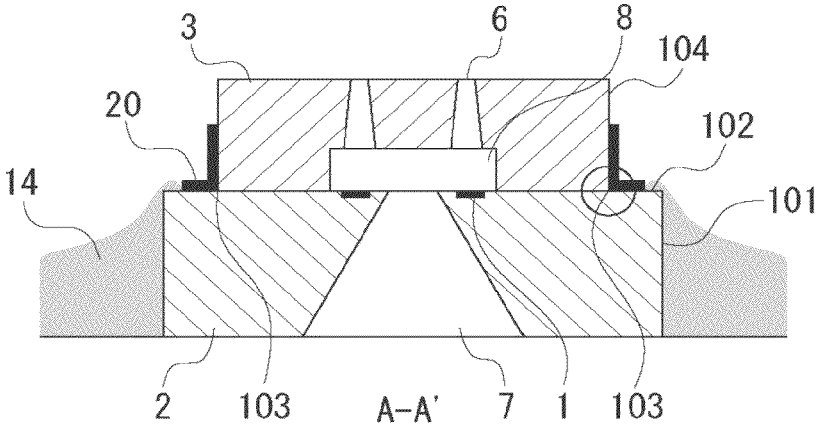
Figure 1C:
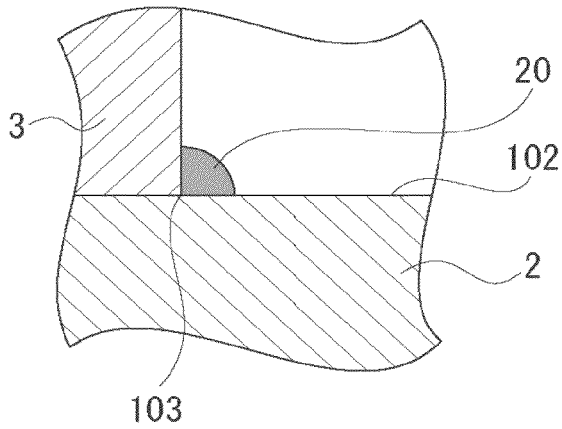
Figure 6A:
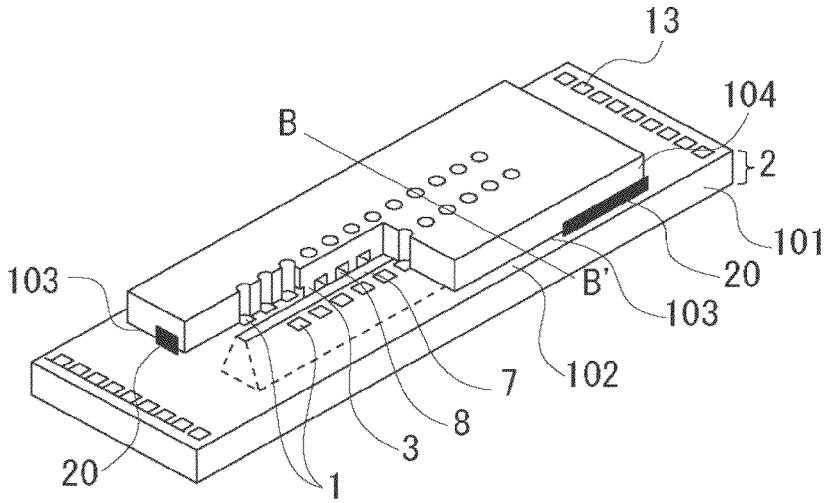
FIGS. 6A and 6B are schematic perspective views of an example of the liquid discharge head of the present invention.
Figure 6B:
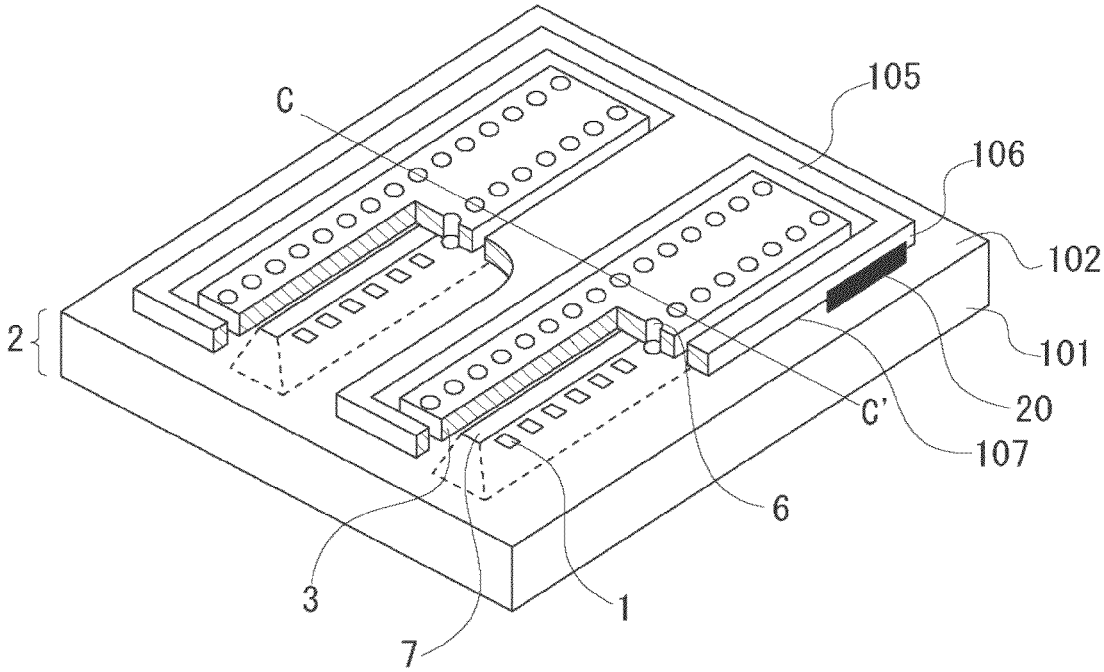

FIGS. 6A and 6B are schematic perspective views of a liquid discharge head according to an exemplary embodiment of the present invention, and FIGS. 1A, 1B, and 1C are a top view A and a cross-sectional view B of the liquid discharge head. FIG. 1B is a cross-sectional view taken along A-A' line in FIG. 1A. FIG. 1C is an enlarged view of a part of FIG. 1B.

As illustrated in FIGS. 1 and 6, the liquid discharge head of the present invention includes a substrate 2 on which two lines of energy generating elements 1 for generating energy for discharging liquid such as ink are formed at a predetermined pitch and connection electrodes 13 for electrically connecting to the outside are formed. In the substrate 2, a supply opening 7 is formed between the two lines of energy generating elements 1. Over a surface 102 which is one of the two surfaces of the substrate 2, discharge ports 6 opened above each energy generating element 1, and individual flow paths 8 connected from the supply opening 7 to each discharge port 6 are formed by a flow path wall member 3. On the surface of the substrate 2, an adhesive layer (not illustrated in the figures) for improving adhesion between the substrate 2 and the flow path wall member 3 may be provided. The flow path wall member 3 is formed by a cured material of a resin composition including an epoxy resin or the like, but it is not limited to this material, and a metal or the like can be used.

The substrate 2 is electrically connected to an electric wiring member 100 via lead wires 12 of the liquid discharge head. Around the end surfaces 101 of the substrate 2, a sealing member 14 is provided by a dispensing method or the like, and further, a sealing member 15 made of a cured material of a resin composition is provided.

As illustrated in FIGS. 1A, 1B, 1C and 6A, the liquid discharge head according to the exemplary embodiment of the present invention includes a liquid repellent member 20 covering at least a part of an intersection line 103 located along a connection portion between the surface 102 which is one of the two surfaces of the substrate 2 and a outer lateral surface 104 of the flow path wall member 3 provided on the surface 102. A contact angle of the resin composition for forming the sealing member 15 on the liquid repellent member 20 is larger than a contact angle of the resin composition for forming the sealing member 15 on the flow path wall member 3 and the surface 102. A water contact angle of the liquid repellent member 20 is larger than the water contact angle of the flow path wall member 3 and the surface 102. Since the liquid repellent member 20 is provided along the intersection line, liquid such as ink, and the sealing member 14 described below are difficult to come close to the intersection line.

A pure water static advancing contact angle of the liquid repellent member 20 can be 80 degrees or more, and more preferably, can be 90 degrees or more. More preferably, it can be 100 degrees or more. The surface 102 is coated with an inorganic or organic insulating film, or a metal protective film. The contact angle for the metal protective film and the inorganic film is 50 degrees or less, and the contact angle for the organic insulating film such as a thermoplastic resin is 70 degrees or less. The contact angle of the flow path wall member is 50 degrees or less when it is a metal, and is 70 degrees or less when it is a cured resin material.

The liquid repellent member 20 is formed by a material such as fluorine, a chemical compound containing silicon, and a resin.

The liquid repellent member 20 may be layered as illustrated in FIG. 1B, and provided in contact with the outer lateral surface 104 of the flow path wall member and the surface 102 at an angle, or as illustrated in FIG. 1C, the outer surface may have a rounded shape. The liquid repellent member 20 may also be provided along the entire intersection line around the flow path wall member 3.

In the above description, the discharge ports 6 are provided in the flow path wall member 3. However, the flow path wall member and a discharge port member which forms the discharge ports 6 may be provided separately. This will be illustrated using an example in the description of the manufacturing method.

In the liquid discharge head illustrated in FIG. 6B, a surrounding member 105 is provided around the flow path wall member 3, and the liquid repellent member 20 is provided covering at least a part of an intersection line 107 between the outer lateral surface 106 of the surrounding member of the flow path wall member 3 and the surface 102. When the flow path wall member is formed by a resin cured material, the surrounding member 105 is preferably formed by the same cured material. For example, by providing the surrounding member 105 having the same height as that of the flow path wall member, it is possible to produce effects such as improved wiping characteristics and improved protection of an element surface of the substrate. Similar to the liquid discharge head in FIG. 6A, the liquid repellent member 20 has a water contact angle larger than that of both the surrounding member and the surface 102. Since the liquid repellent member 20 is provided along the intersection line 107, liquid such as ink, and the sealing member 14 described below do not easily come in contact with the side surfaces of the substrate.

An example of the manufacturing method of the liquid discharge head according to the first exemplary embodiment of the present invention will be described below. FIGS. 2A, 2B, 2C, 2D, 2E, 2F, and 2G are schematic cross-sectional views illustrating an example of the manufacturing method of the liquid discharge head of the present invention, and these cross-sectional views are similar to that of FIG. 1B.

Figure 2A:
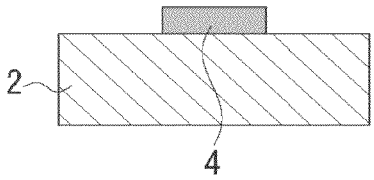
FIGS. 2A, 2B, 2C, 2D, 2E, 2F and 2G are schematic cross-sectional views illustrating an example of a manufacturing method of the liquid discharge head of the present invention.

As illustrated in FIG. 2A, a dissolvable resin layer 4 which is a mold of the flow path is formed on the substrate 2 including the energy generating elements 1 (not illustrated in FIG. 2A). The dissolvable resin layer 4 is formed by a pattern having a shape of the flow path 8. For example, after lamination of a dry film or coating with a resist by spin coating on the dissolvable resin layer 4, a patterning is performed on the dissolvable resin layer 4, for example, by exposure with ultraviolet rays (deep-UV light) and development. As an specific example, polymethyl isopropenyl ketone (ODUR-1010 manufactured by TOKYO OHKA KOGYO CO., LTD.) is coated on the dissolvable resin layer 4 by spin coating and dried, and then the dissolvable resin layer 4 is exposed to the deep-UV light and a patterning is performed on the dissolvable resin layer 4 by development.

Figure 2B:
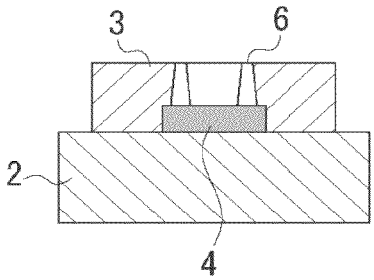

Next, as illustrated in FIG. 2B, after coating with the flow path wall member 3 on the dissolvable resin layer 4, the flow path wall member in which the discharge ports 6 are formed is formed by performing ultraviolet-ray exposure (deep-UV light exposure) and developing the flow path wall member 3.

Figure 2C:
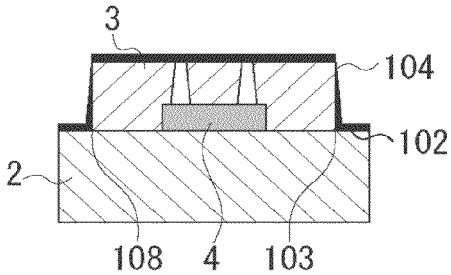

Next, as illustrated in FIG. 2C, a liquid repellent material layer 108 is provided such that the liquid repellent material layer 108 covers the flow path wall member 3, comes in contact with the outer lateral surfaces 104 and the surface 102, and covers the intersection line 103. The liquid repellent material is a photosensitive liquid repellent material which is applied by spin coating, laminating, or the like, and on which a patterning can be performed by, for example, exposure with ultraviolet rays (deep-UV light) and development. For example, the liquid repellent material is a film formed by a resin including an epoxy group containing a fluorine atom and a photopolymerization initiator.

Figure 2D:
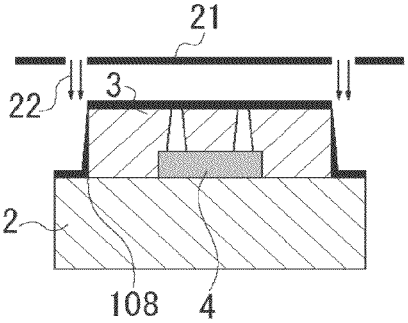
Figure 2E:
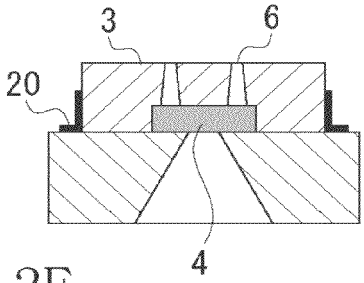

After providing the liquid repellent material, by using a photo mask 21 as illustrated in FIG. 2D and performing ultraviolet-ray exposure (deep-UV light exposure) and development, the liquid repellent member 20 can be formed only in a necessary area illustrated in FIG. 2E.

Figure 2F:
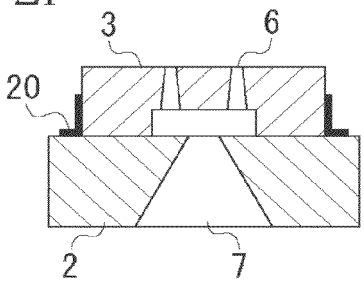
Figure 2G:
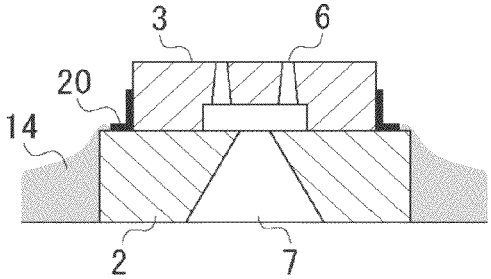

Next, as illustrated in FIG. 2F, the liquid supply opening 7 is formed by chemically etching the substrate 2. For example, when using a Si substrate as the substrate 2, the supply opening 7 is formed by anisotropic etching using a strong alkaline solution such as KOH, NaOH, and TMAH.

Next, by dissolving the dissolvable resin layer 4, the resin in the flow path 8 is removed. The dissolvable resin layer 4 can be removed by dissolving and drying the dissolvable resin layer 4 after performing entire exposure using the deep-UV light. If ultrasonic processing is performed during the dissolution, the dissolvable resin layer 4 can be removed more quickly and completely.

Although not illustrated in FIG. 2, the substrates 2 on which an ink jet mechanism is provided are manufactured in a wafer form in which many chips are continuously arranged. Therefore, after manufacturing the wafer, the substrates 2 are cut and separated into chips by a dicing saw or the like.

As illustrated in FIG. 2F, after making electric connection for driving the energy generating elements 1, a member such as an ink tank for supplying ink is attached. A resin composition is formed such that the resin composition fills the circumference of the substrate. The resin composition is cured to form the sealing member 14 and the sealing member 15 for protecting the leads, and the liquid discharge head is completed.

As the sealing member, an amine curing type epoxy resin composition or the like can be used, and as a base resin thereof, an epoxy resin having a butadiene skeleton, an alicyclic epoxy resin, and a bisphenol A-type epoxy resin can be used. The resin composition includes a filler, a curing auxiliary catalyst, and a solvent in addition to the base resin and a curing agent. As a sealing method with the composition, the composition is applied by the dispensing method or the like, and cured by heat or light to perform the sealing. The contact angle of the composition for the sealing member on the liquid repellent member is larger than the contact angles of the composition for the sealing member on both the flow path wall member 3 and the surface 102, and thus even when the composition of the sealing member overflows on the surface 102, it is possible to prevent the composition for the sealing member from coming close to the intersection line 103.

In the present exemplary embodiment, the thickness of the flow path wall member 3 on the substrate is about 75 μm, and the distance from the side surface of the substrate to the side surface of the flow path wall member is about 10 to 50 μm.

Figure 3A:
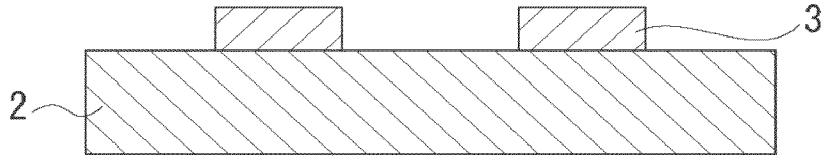
FIGS. 3A, 3B, and 3C are schematic cross-sectional views illustrating an example of the manufacturing method of the liquid discharge head of the present invention.
Figure 3B:
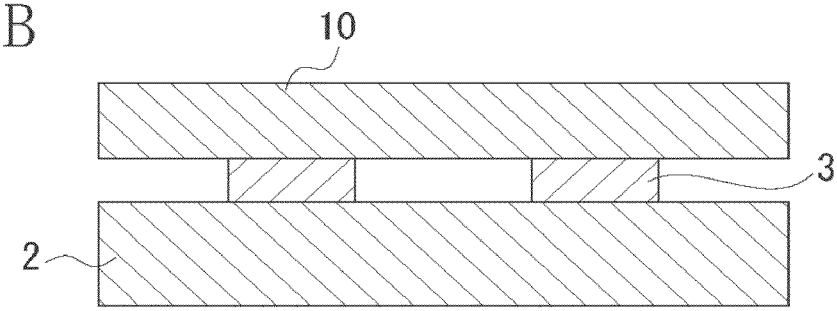
Figure 3C:
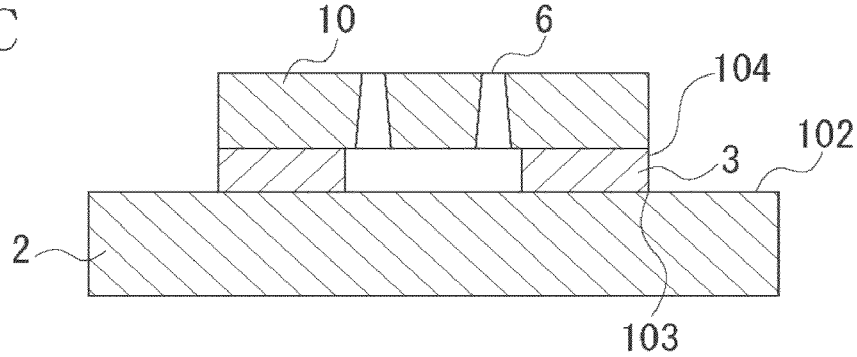

An example of the manufacturing method of the liquid discharge head according to a second exemplary embodiment of the present invention will be described below. FIGS. 3A, 3B, and 3C are schematic cross-sectional views illustrating an example of the manufacturing method of the liquid discharge head of the present invention, and these cross-sectional views are similar to that of FIG. 1B.

As illustrated in FIG. 3A, a material of the member which forms the flow path wall portion is applied on the substrate 2 which includes the energy generating elements 1, by spin coating. This material is a photosensitive resist, and a patterning is performed on the material by ultraviolet-ray exposure (deep-UV light exposure) and development to form the flow path wall member 3.

Next, as illustrated in FIG. 3B, an orifice plate layer 10 (an orifice plate portion) which is a discharge port member provided with the discharge ports is formed of a laminated dry film.

The orifice plate layer 10 of the dry film is a resist of the same photosensitivity as the flow path wall member 3, and generally the orifice plate layer 10 and the flow path wall member 3 are formed by the same material from the view point of connection characteristics of the upper part of the flow path wall member.

Since the orifice plate layer 10 of the dry film is laminated in an appropriate condition, the orifice plate layer 10 is formed as if a lid were placed on the flow path wall member 3 without filling in the ink path between the flow path walls formed by the flow path wall member 3.

Next, as illustrated in FIG. 3C, by performing ultraviolet-ray exposure (deep-UV light exposure) on the orifice plate layer 10 of the dry film and developing the orifice plate layer 10, the discharge ports 6 are formed.

The subsequent processes are performed in the same way as in the first exemplary embodiment. The liquid repellent member is provided along the intersection line 103 between the surface 102 and the outer lateral surface 104 in FIG. 3C.

An example of the manufacturing method of the liquid discharge head according to a third exemplary embodiment of the present invention will be described below. FIGS. 4A, 4B, 4C, 4D, 4E, and 4F are schematic cross-sectional views illustrating an example of the manufacturing method of the liquid discharge head of the present invention, and these cross-sectional views are similar to that of FIG. 1B.

Figure 4A:
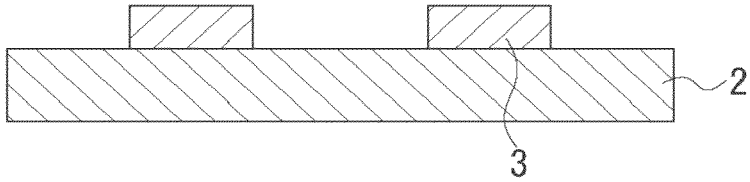
FIGS. 4A, 4B, 4C, 4D, 4E, and 4F are schematic cross-sectional views illustrating an example of the manufacturing method of the liquid discharge head of the present invention.

As illustrated in FIG. 4A, the flow path wall member 3 which forms only the flow path walls is applied on the substrate 2 which includes the energy generating elements 1, by spin coating.

The material for the flow path wall member 3 is a photosensitive resist, and a patterning is performed on the material by ultraviolet-ray exposure (deep-UV light exposure) and development to form the flow path wall member 3.

Figure 4B:
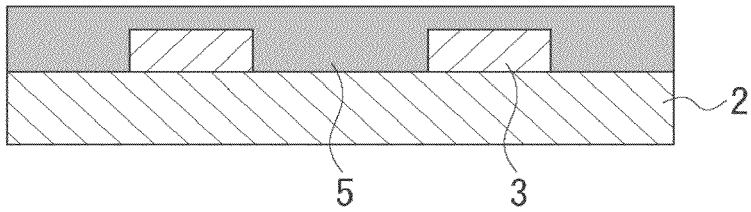

Next, as illustrated in FIG. 4B, a material 5 for implanting is accumulated to cover the substrate 2 and the flow path wall member 3. An acrylic material for the implanting material can be used to prevent the flow path wall from falling during chemical mechanical polishing (CMP) in the next process.

Figure 4C:
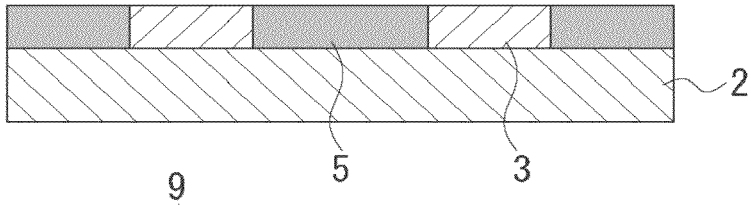

Next, the top surface of the implanting material 5 is polished and cleaned by the chemical mechanical polishing (CMP) until the top surface of the flow path wall is exposed, and the form subjected to flattening processing as illustrated in FIG. 4C appears.

Figure 4D:
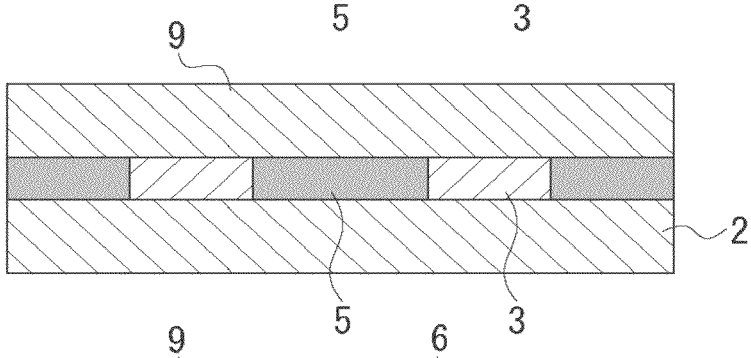

Next, as illustrated in FIG. 4D, an orifice plate layer 9 which becomes an orifice plate portion of the discharge ports is applied by spin coating.

The orifice plate layer 10 is a resist of the same photosensitivity as the flow path wall member 3, and generally the orifice plate layer 10 and the flow path wall member 3 are formed with the same material from the viewpoint of connection characteristics of the upper part of the flow path wall member. The orifice plate layer 10 may be formed by a laminated dry film.

Figure 4E:
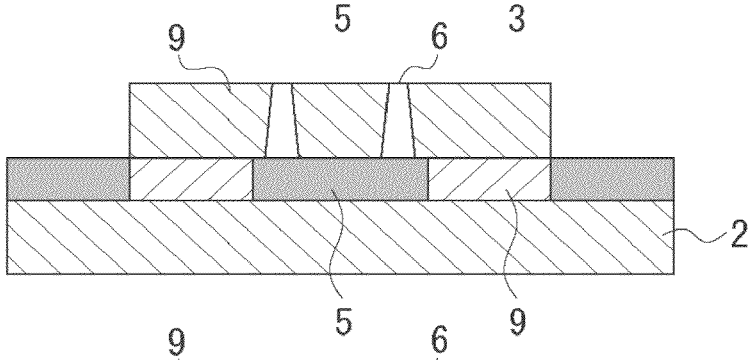
Figure 4F:
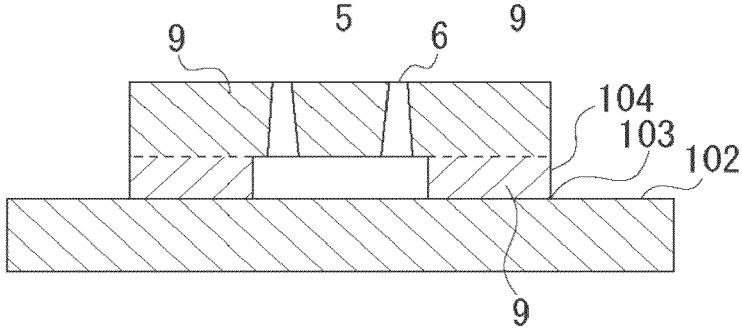

Next, as illustrated in FIG. 4E, by performing ultraviolet-ray exposure (deep-UV light exposure) on the orifice plate layer 10 of a dry film and developing the orifice plate layer 10, the discharge ports 6 are formed. Further, the unnecessary implanting material 5 is removed to form the surface 102, the outer lateral surface 104, and the intersection line 103, so that the form illustrated in FIG. 4F appears.

The subsequent processes are performed in the same way as in the first exemplary embodiment.

Figure 5A:
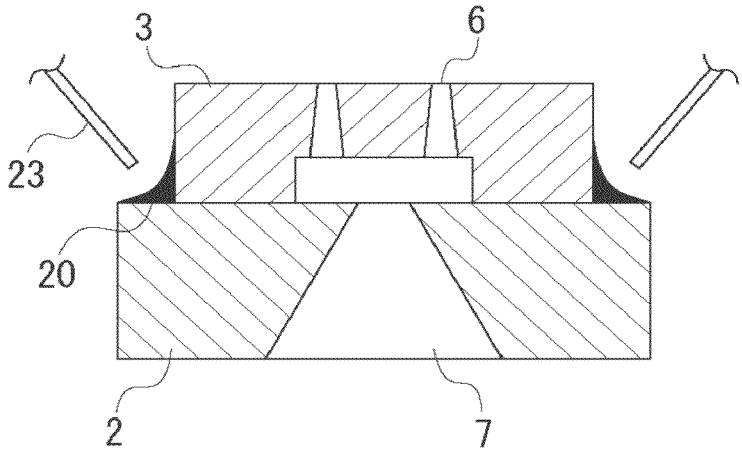
FIGS. 5A, 5B, and 5C are schematic cross-sectional views illustrating an example of the manufacturing method of the liquid discharge head of the present invention.
Figure 5B:
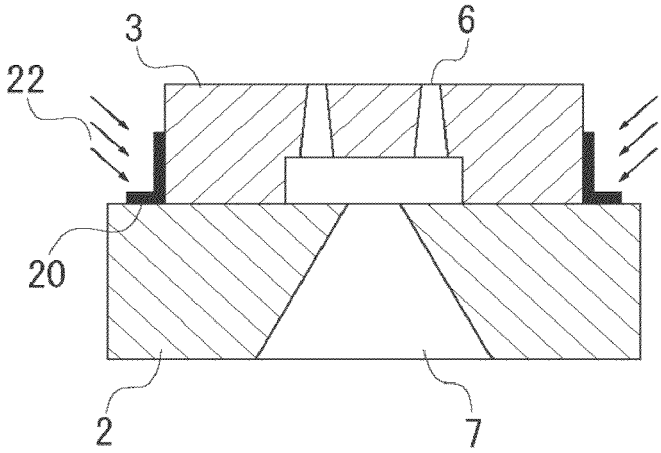
Figure 5C:
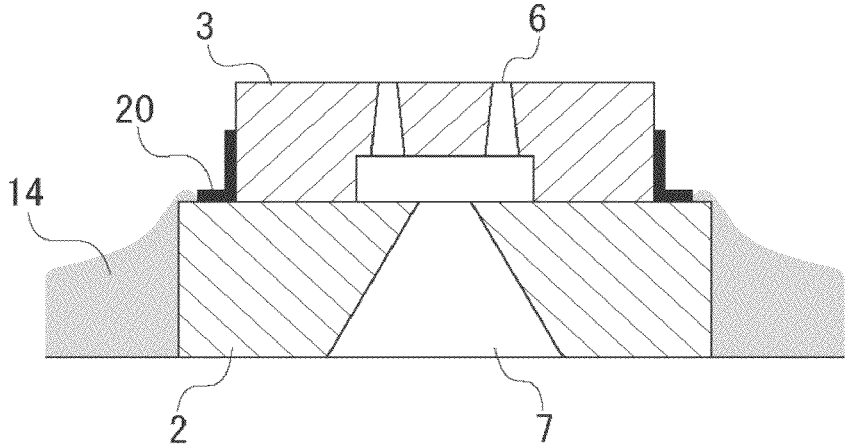

FIGS. 5A, 5B, 5C are diagrams illustrating the manufacturing method of a fourth exemplary embodiment, and these diagrams are cross-sectional views similar to that of FIG. 2.

As illustrated in FIG. 5A, after providing electric connection for driving the energy generating elements 1, a member such as a liquid accommodating member for supplying liquid is attached, and the liquid repellent material is applied by a needle 23. At this time, the liquid repellent material which can be used is, for example, a composition including a condensation of a silane compound containing a fluorine-containing group and a silane compound containing a cationic polymerization group, and a photoacid generating agent. Of course, the liquid repellent material is not limited to the above.

Then, as illustrated in FIG. 5B, the material is irradiated with ultra-violet rays (deep-UV light) 22, and the liquid repellent material is cured to form the liquid repellent member.

Then, as illustrated in FIG. 5C, the sealing member 14 which fills the circumference of the substrate and the sealing member 15 which protects the leads are formed, and the liquid discharge head is completed.

In the present exemplary embodiment, the liquid repellent processing is not performed in a photolithography process, but performed in a mounting process, so that there is an advantage that the liquid repellent processing can be easily performed without using large-scale production equipment.

The liquid discharge head can be applied to various industrial fields such as discharging a wiring forming material and an electronic component forming material, in addition to the ink jet recording method.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-143524 filed Jun. 16, 2009, which is hereby incorporated by reference herein in its entirety.

What is claimed is:

1. A liquid discharge head comprising:

a substrate;

a flow path wall member provided with a wall of a liquid flow path connected to a discharge port for discharging liquid, the liquid flow path being formed by the flow path wall member and one surface of the substrate which are in contact with each other; and a coated resin member made of a resin composition provided to cover end surfaces of the substrate, wherein a liquid repellent member having a contact angle of the resin composition larger than that of both the flow path wall member and the one surface is provided to cover at least a part of an intersection line between an outer lateral surface of the flow path wall member and the one surface.

2. The liquid discharge head according to claim 1, wherein the liquid repellent member has a water contact angle of 90 degrees or more.

3. The liquid discharge head according to claim 1, wherein the liquid repellent member is provided over the outer lateral surface and the one surface.

4. The liquid discharge head according to claim 1, wherein the liquid repellent member is provided over the entire intersection line.

5. The liquid discharge head according to claim 1, wherein a sealing member is provided to be in contact with an end surface of the substrate and the one surface.

6. A liquid discharge head comprising:

a substrate;

a flow path wall member provided with a wall of a liquid flow path connected to a discharge port for discharging liquid and made of a resin cured material, the liquid flow path being formed by the flow path wall member and one surface of the substrate which are in contact with each other;

a surrounding member made of the resin cured material provided to surround the flow path wall member on the one surface; and a coated resin member made of a resin provided to cover end surfaces of the substrate, wherein a liquid repellent member having a contact angle of the resin composition larger than that of both the surrounding member and the one surface is provided to cover at least a part of an intersection line between an outer lateral surface of the surrounding member and the one surface.

7. A liquid discharge head comprising:

a substrate;

a flow path wall member provided with a wall of a liquid flow path connected to a discharge port for discharging liquid and made of a resin cured material, the liquid flow path being formed by the flow path wall member and one surface of the substrate which are in contact with each other; and a coated resin member made of a resin provided to cover end surfaces of the substrate, wherein a liquid repellent member having a water contact angle larger than water contact angles of both the flow path wall member and the one surface is provided to cover at least a part of an intersection line between an outer lateral surface of the surrounding member and the one surface.

8. A liquid discharge head comprising:

a substrate;

a flow path wall member provided with a wall of a liquid flow path connected to a discharge port for discharging liquid and made of a resin cured material, the liquid flow path being formed by the flow path wall member and one surface of the substrate which are in contact with each other;

a surrounding member made of the resin cured material provided to surround the flow path wall member on the one surface; and a coated resin member made of a resin provided to cover end surfaces of the substrate, wherein a liquid repellent member having a water contact angle larger than water contact angles of both the surrounding member and the one surface is provided to cover at least a part of an intersection line between an outer lateral surface of the surrounding member and the one surface.

9. A liquid discharge head comprising:

a substrate;

a flow path wall member provided with a wall of a liquid flow path connected to a discharge port for discharging liquid, the liquid flow path being formed by the flow path wall member and one surface of the substrate which are in contact with each other; and a coated resin member made of a resin provided to cover end surfaces of the substrate, wherein a liquid repellent member having a water contact angle of 90 degrees or more is provided to cover at least a part of an intersection line between an outer lateral surface of the flow path wall member and the one surface.

10. A liquid discharge head comprising:

a substrate;

a flow path wall member provided with a wall of a liquid flow path connected to a discharge port for discharging liquid, the liquid flow path being formed by the flow path wall member and one surface of the substrate which are in contact with each other;

a surrounding member made of the resin cured material provided to surround the flow path wall member on the one surface; and a coated resin member made of a resin provided to cover end surfaces of the substrate, wherein a liquid repellent member having a water contact angle of 90 degrees or more is provided to cover at least a part of an intersection line between an outer lateral surface of the surrounding member and the one surface.

11. A manufacturing method of a liquid discharge head including a substrate, a flow path wall member provided with a wall of a liquid flow path connected to a discharge port for discharging liquid, the liquid flow path being formed by the wall and one surface of the substrate which are in contact with each other, and a coated resin member made of a resin composition provided to cover end surfaces of the substrate, the manufacturing method comprising in this order:

preparing the substrate with the flow path wall member;

providing a liquid repellent member having a contact angle of the resin composition larger than that of both the flow path wall member and the one surface to cover an intersection line between an outer lateral surface of the flow path wall member and the one surface; and providing the resin composition so as to cover at least a part of the end surfaces of the substrate, to form the coated resin member.

12. The manufacturing method according to claim 11, further comprising:

when providing the liquid repellent member, providing a negative type photosensitive material layer for forming the liquid repellent member to cover the intersection line from the outer lateral surface to the one surface;

exposing the material layer, at least in a portion which covers the intersection line; and removing a portion of the material layer where the exposure is not performed.

13. The manufacturing method according to claim 11, wherein the sealing member is provided by a dispensing method.

14. A manufacturing method of a liquid discharge head including a substrate, a flow path wall member provided with a wall of a liquid flow path connected to a discharge port for discharging liquid, the liquid flow path being formed by the wall and one surface of the substrate which are in contact with each other, a surrounding member made of the resin cured material provided to surround the flow path wall member on the one surface, and a coated resin member made of a resin composition provided to cover end surfaces of the substrate, the manufacturing method comprising in this order:

preparing the substrate with the flow path wall member and with the surrounding member;

providing a liquid repellent member having a contact angle of the resin composition larger than that of both the flow path wall member and the one surface to cover an intersection line between an outer lateral surface of the surrounding member and the one surface; and providing the resin composition so as to cover at least a part of the end surfaces of the substrate, to form the coated resin member.

* * * * *